US005964606A

United States Patent [19]

Choy

[11] Patent Number: 5,964,606

[45] Date of Patent: Oct. 12, 1999

[54] STRUCTURE OF SLANTED DIMM CONNECTOR FOR DENSE ARRANGEMENT

[75] Inventor: Edmond Choy, Union City, Calif.

[73] Assignee: Hon Hai Precision Ind. Co., Ltd., Taipei Hsien, Taiwan

[21] Appl. No.: 08/903,119

[22] Filed: Jul. 30, 1997

[51] Int. Cl.[6] ..... H01R 13/62

[52] U.S. Cl. ..... 439/160; 439/637

[58] Field of Search ..... 439/160, 326, 439/541.5, 540.1, 637, 61, 157

[56] References Cited

U.S. PATENT DOCUMENTS 5,511,985 4/1996 Noschese ..... 439/157

*Primary Examiner*—Steven L. Stephan
*Assistant Examiner*—Javaid Nasri

[57] ABSTRACT

A slanted DIMM connector (10) includes an insulative housing (12) defining a central slot (13) for receiving a module therein and a pair of ejectors (16) rotatably positioned within a pair of corresponding towers (14) adjacent two opposite ends of the housing (12). Three support blocks (18) extend forward from a center portion and two opposite end portions wherein each of the support blocks (18) about the end portion has a cut-off (36) in alignment with the tower (14). When the two slanted DIMM connectors (10) are closely side by side arranged on the PC board (100) in a front-to-end direction, the outermost upper edge (40) of the tower (14) of the front connector (10) is substantially aligned with a vertical plate (38) of the cut-off (36) of the adjacent rear slanted DIMM connector (10), so that the rear connector (10) can be directly upward moved from the PC board (100) without interference with the raised tower (14) or any portion of the front connector (10).

9 Claims, 7 Drawing Sheets

STRUCTURE OF SLANTED DIMM CONNECTOR FOR DENSE ARRANGEMENT

BACKGROUND OF THE INVENTION

1. Field of the Invention

The invention relates to card edge connectors, and particularly to the structure of a slanted DIMM (Dual In-line Memory Module) connector which can be side by side closely arranged with another adjacent one while allowing of being removed directly and vertically from the PC board, on which the connector is seated, without interfering with such adjacent connector which is generally structurally positioned about its front side.

2. The Related Art

U.S. Pat. No. 5,511,985 discloses more than one slanted DIMM connectors being side by side closely arranged on a PC board to form a group for receiving a corresponding number of modules therein.

It can be noted that if a plurality of conventional vertical type DIMM connectors side by side closely arranged on the PC board, it is still okay for removal or replacement of one damage/defect DIMM connector among such group because there is no obstacle above each DIMM connector to obstruct the vertical withdrawal of the specific damaged connector from the board.

Differently, the slanted type DIMM connectors group can not directly remove the specific damaged connector from the board in the same way because the front bottom portion of the rear DIMM connector may interfere with the rear upper portion of the front DIMM connector if such slanted type DIMM are side by side (i.e., from the front side to the rear side) closely mounted on the PC board in a form of backward tilting.

Therefore, an object of the invention is to provide slanted DIMM connectors of which a number are adapted to be closely side by side mounted on a PC board while still allowing of removable replacement of any specific damaged one by directly vertically moving such specific defect one if the required de-soldering process has accomplished.

SUMMARY OF THE INVENTION

According to an aspect of the invention, a slanted DIMM connector includes an insulative housing defining a central slot for receiving a module therein and a pair of ejectors rotatably positioned within a pair of corresponding towers adjacent two opposite ends of the housing. Three support blocks extend forward from a center portion and two opposite end portions wherein each of said support about the end portion has a cut-off in alignment with the tower. When the two slanted DIMM connectors are closely side by side arranged on the PC board in a front-to-end direction, the outermost upper edge of the tower of the front connector is substantially aligned with the a vertical plate of the cut-off of the adjacent rear slanted DIMM, so that the rear connector can be directly upward moved from the PC board without interference with the raised tower or any portion of the front connector.

DETAILED DESCRIPTION OF THE PREFERRED EMBODIMENTS

Figure 1:
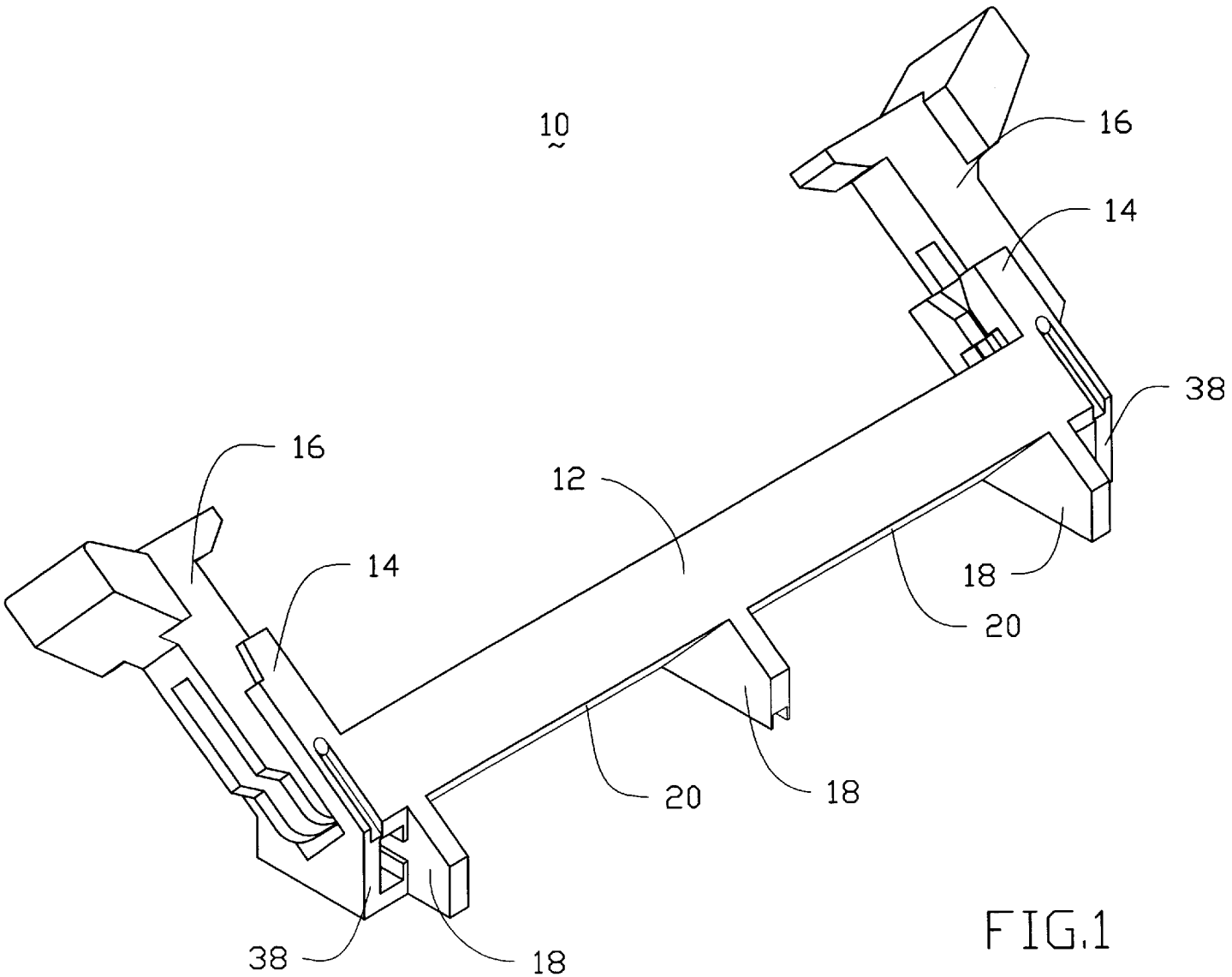
FIG. 1 is a front perspective view of a presently preferred embodiment of the slanted DIMM connector without contacts therein, according to the invention.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–5 wherein a slanted DIMM connector 10 includes an insulative housing 12 defined a central slot 13 (FIG. 5) with two rows of contacts 70 in the respective passageways 71 (FIG. 5) by two side thereof to receive a module (not shown) therein. A pair of raised towers 14 are formed at two opposite ends of the housing 12 each for receiving a rotatable ejector 16 therein. The ejector 16 cooperates with the module to retain or release the module in or from the housing 12.

To stabilize the housing 12 on the PC board 100 (FIG. 3), three first support blocks 18 extend forward from the front downward facing surface 20 with a predetermined distance. These blocks 18 provides not only additional support points for enlargement of the seating area of the housing 12, but also protection walls for covering the contact tails 22 in the lateral direction and preventing the contact tails 22 from the lateral hit. Similarly, three second support blocks 24 (FIG. 5) extend rearward from a rear side surface 26 until its vertical ending edge 28 is somewhat close to the outermost edge 30 of the housing 12. These blocks 24 also provide additional supporting function for stabilization of the whole connector 10.

Figure 4:
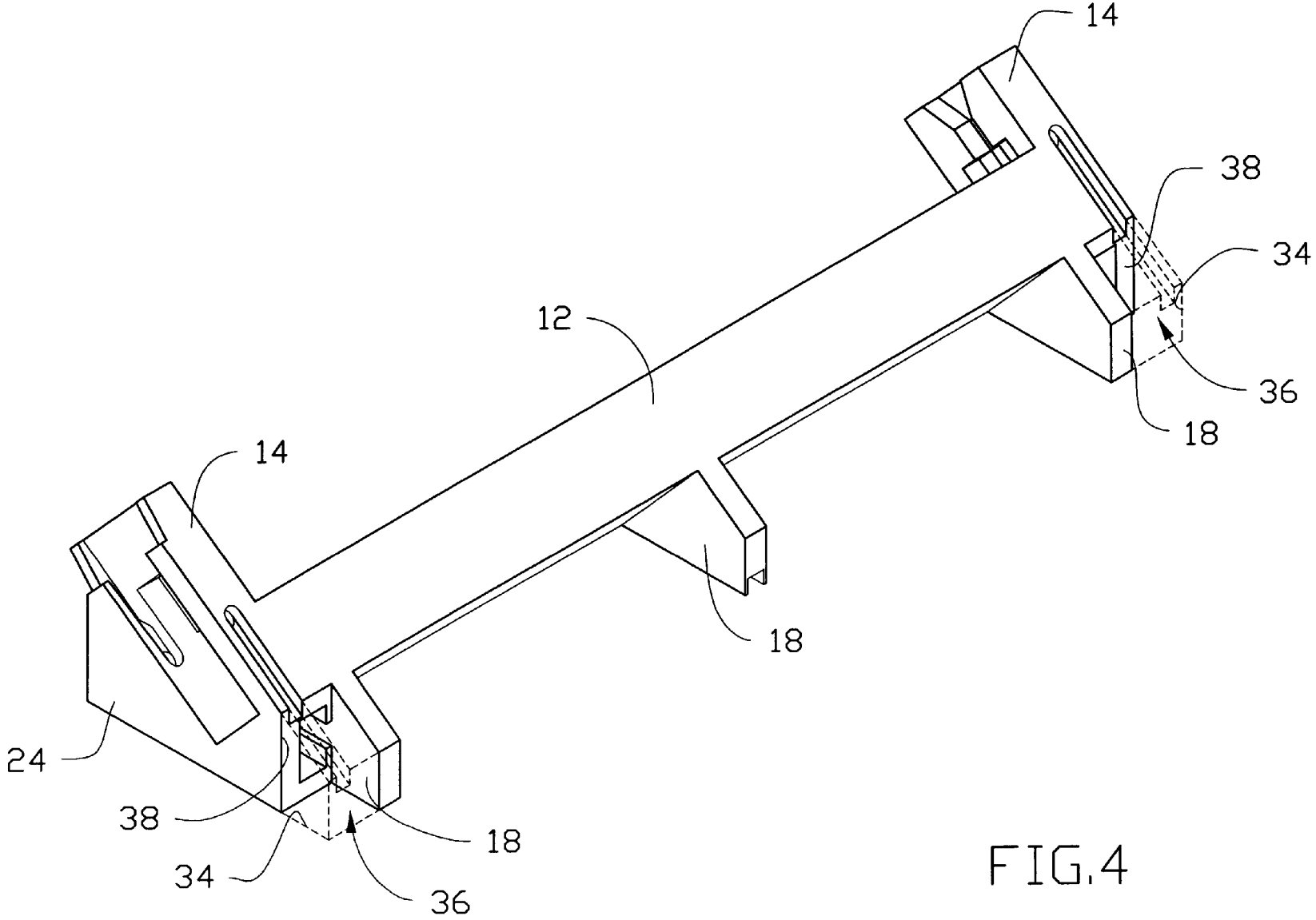
FIG. 4 is a perspective view of the slanted connector of FIG. 1 with the dashed lines to show the original slanted connector should be before the cut-off is formed.

It should be known that because there are two blocks 18 and the two blocks 24 are positioned close to the tower 14, the forward extending blocks 18 and the rearward extending blocks 24 thereabout naturally and originally designedly laterally extend integral with the corresponding adjacent tower 14 to form such huge pier like block 18, 24 as shown in the dashed lines structure in FIG. 4.

One important feature of the invention is that because the space of the PC board is limited, the slanted connectors 10 should be closely and compactly side by side mounted on the PC board 100. Such mounting should result in no interference not only between every two adjacent slanted connectors 10 themselves in an inoperative condition, i.e., no module therein, but also among such two connectors including their associated inserted module therein during an operation state. Anyhow, some manufacturer further requests that no obstacle exist when any one of the compactly side by side positioned slanted connectors is intended to be removed from the PC board 100 for replacement or rework through a de-soldering process. It can be seen that because the contact tails 22 are of a vertical type, the removal of such connector should be along a vertical upward direction.

Figure 2:
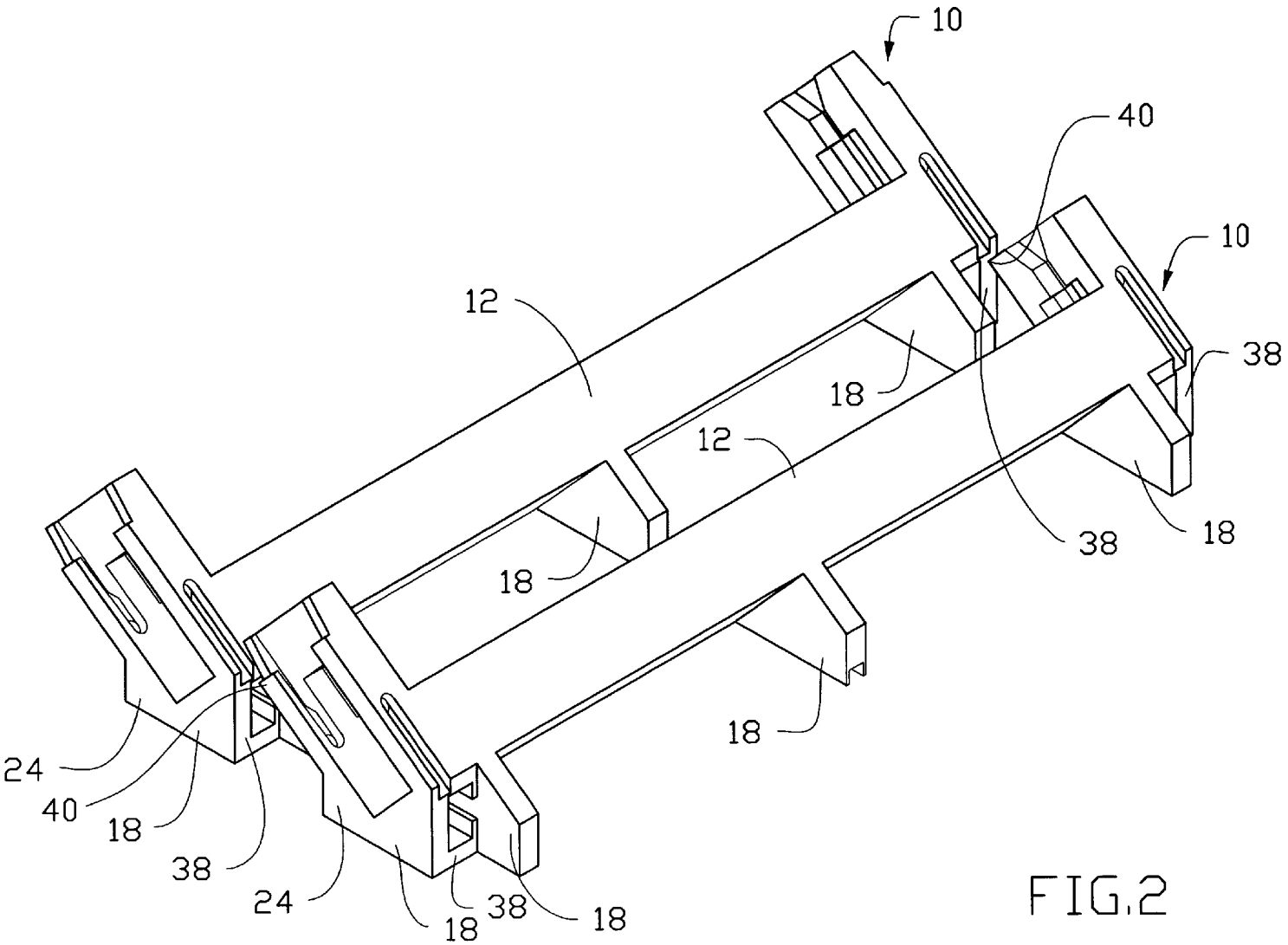
FIG. 2 is a front perspective view of two slanted DIMM connectors of FIG. 1 which are closely side by side arranged together and aligned with each other in a front-to-end direction.
Figure 3:
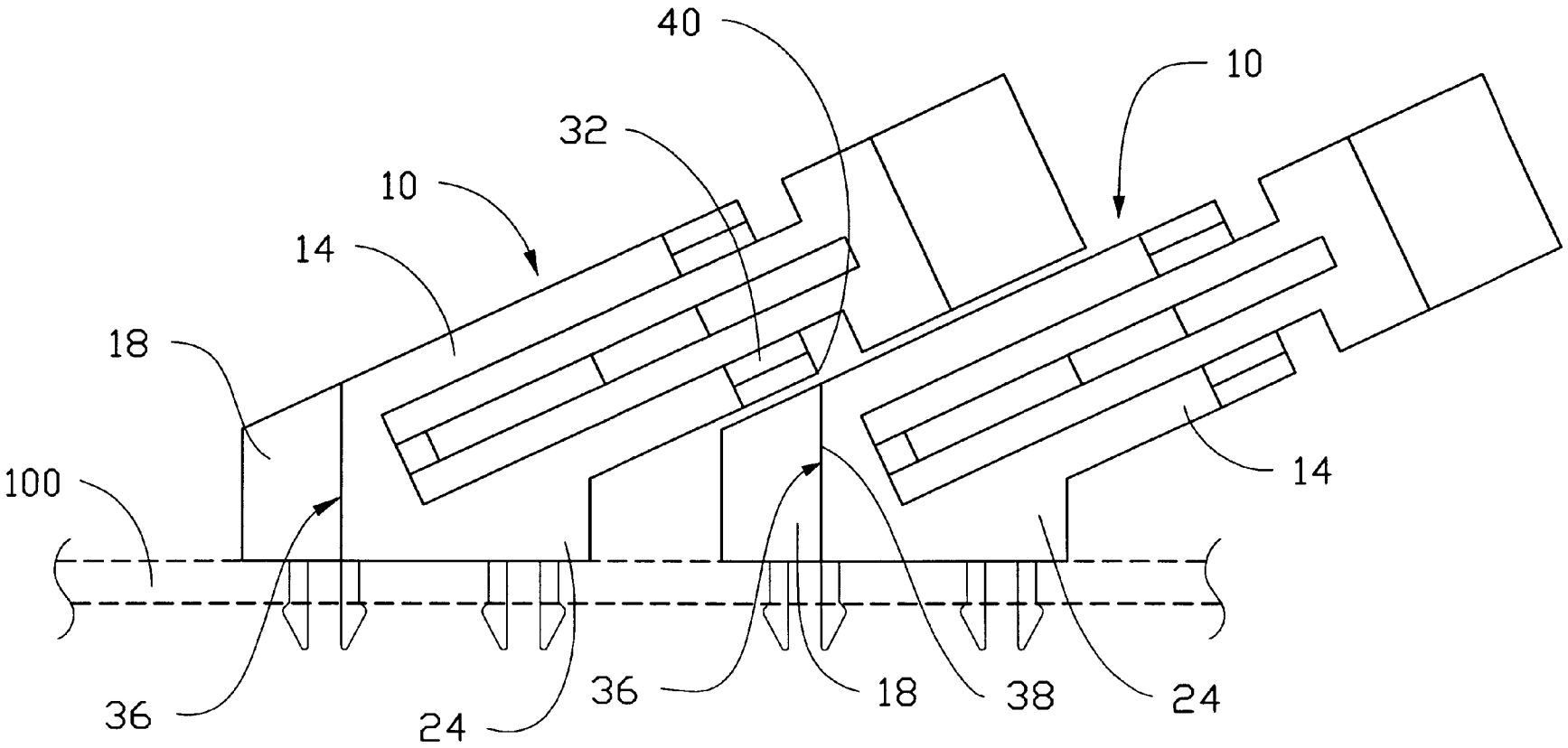
FIG. 3 is a side view of two closely side by side arranged slanted DIMM connectors of FIG. 2 to show how close the front connector and the rear connector are but without an interference therebetween if the rear connector is upward removed from the PC board.

It can be appreciated that if the connector 10 is configured to be a physical body as shown in FIGS. 2, 3 and 4 including the dashed line structures, i.e., the contour of the original slanted connector 10, it will definitely result in an interference between the upper portion 32 of the tower 14 of the front connector 10 and an uncut portion 34 depicted by the dashed line of the first block 18 of the rear connector 10. Oppositely, when the front block 18 has intentionally removed a cut-off 36, whose lateral dimension is substantially equal to width of the tower 14, and the cut vertical surface 38 adjacent the bottom of the tower 14 of the rear connector 10 is generally aligned with the outermost edge 40 of the tower 14 of the front connector 10, such cut-off 36 can provide a sufficient space to allow the housing 12 of the rear connector 10 to be vertically moved with regard to the PC board 100 without resulting in any conflict against the raised portion of the tower 14 of the front connector 10. Understandably, this upward movement should be done without any module being received within the housing 12 of the front connector 10 and the ejectors 16 thereof are in an open status with regard to the housing 12.

Figure 5:
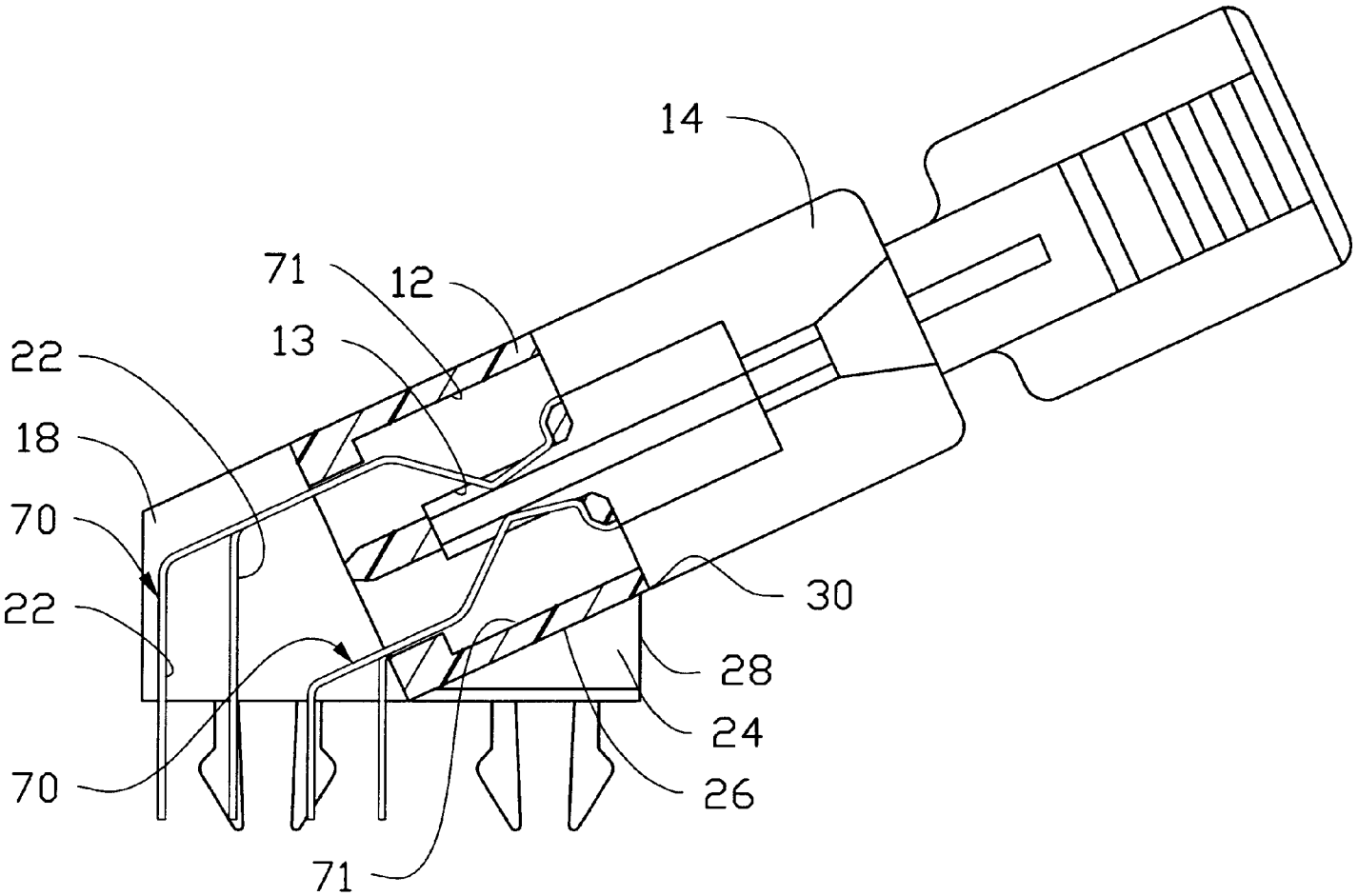
FIG. 5 is a cross-sectional view of the connector of FIG. 1 to show how the block protect the contact tails.

FIG. 5 shows how the contact tails are protected by the blocks 18 for avoidance of any lateral impact.

Figure 6:
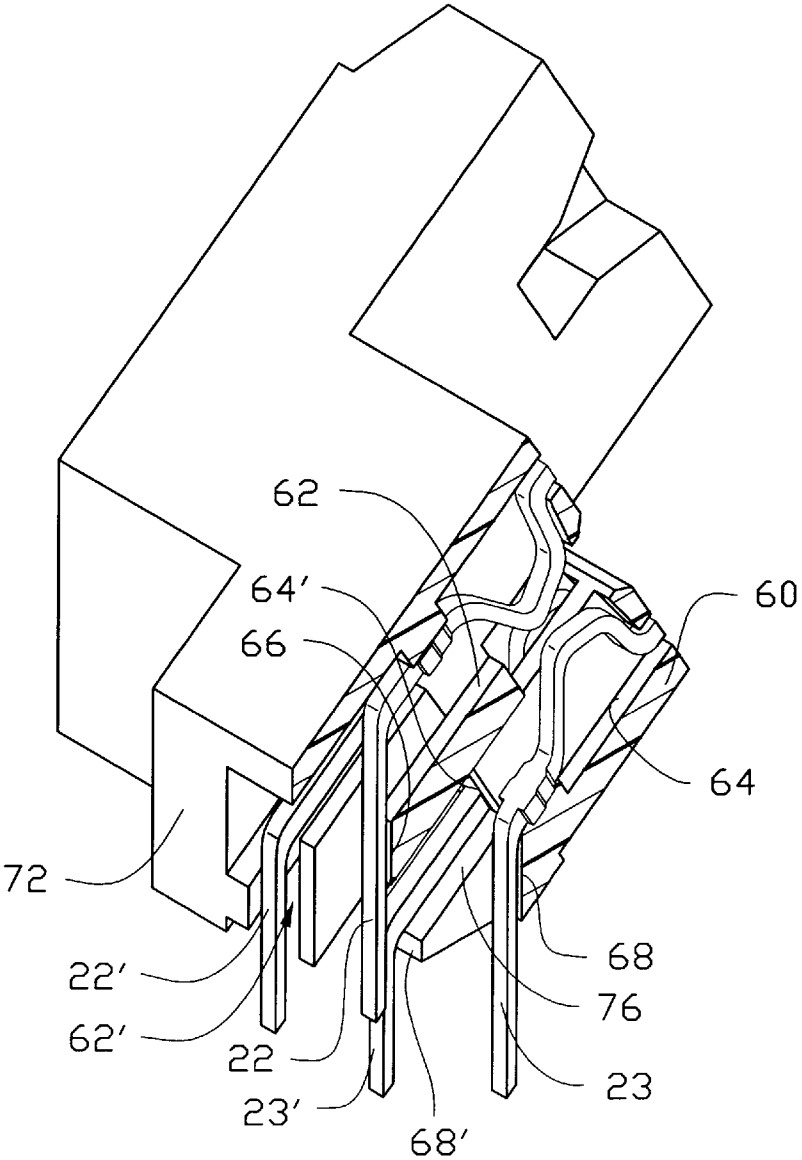
FIG. 6 is another embodiment of a slanted connector to show how the contact tails are guidably aligned for mating with the corresponding holes in the board.

FIG. 6 is another embodiment of the invention wherein the basic structure of the housing 60 replaces the original square cross-sectional type one of the first embodiment. From another viewpoint, the space between every two adjacent blocks 18 is filled with the insulative housing 60. Accordingly, the housing 60 defines an elongated cross-sectional configuration wherein one pair of upper passageway 62 and lower passageway 64 respectively defines a first reference vertical plane 66 and a second reference vertical plane 68, and first plane 66 of the upper passageway 62 is substantially positioned close to the front vertical surface 72 than the second plane 68 of the lower passageway 64 so that the upper row contact tail 22 which extends downward along the first plane 66 is offset from the lower row contact tail 23 which extends downward along the second plane 68 in the lateral direction. Similarly, the next adjacent upper and lower passageways 62' and 64' also define respectively a third reference vertical plane (not shown) and a fourth reference vertical plane 68' wherein the third plane (not shown) of the upper passageway 62' is positioned substantially close to the front vertical surface 72 than the four plane 68' of the lower passageway 24', so that the upper row contact tail 22' extending downward along the third plane (not shown) is offset from the resulting in an offset, in a lateral direction, from the lower row contact tail 23' downward extending along the fourth plane 68'.

It is further noted that from a side view, the third plane (not shown), the first plane 66, the fourth plane 68' and the second plane 68 are arranged offset from each other in order in the lateral direction so that the contact holes in the corresponding PC board can be managed in an even manner. It is also seen this extended type housing 60 also provides a slanted surface 76 within the corresponding lower passageway 64' for supportable engagement with the slanted portion of the downward extending lower row contact tail 23'.

It can be contemplated that in this embodiment, the housing 60 includes extended portions around its front bottom section in alignment with each corresponding passageways 62, 62', 64 and 64', so that the contact tails 22, 22', 23 and 23' with the corresponding passageways 62,, 62', 64 and 64' may be efficiently controllably arranged in the predetermined specific position in vertical alignment with the evenly spaced corresponding holes in the PC board on which the connector is mounted, thus eliminating any additional spacer attached to the front bottom section of the housing 60 for alignment purpose.

Figure 7:
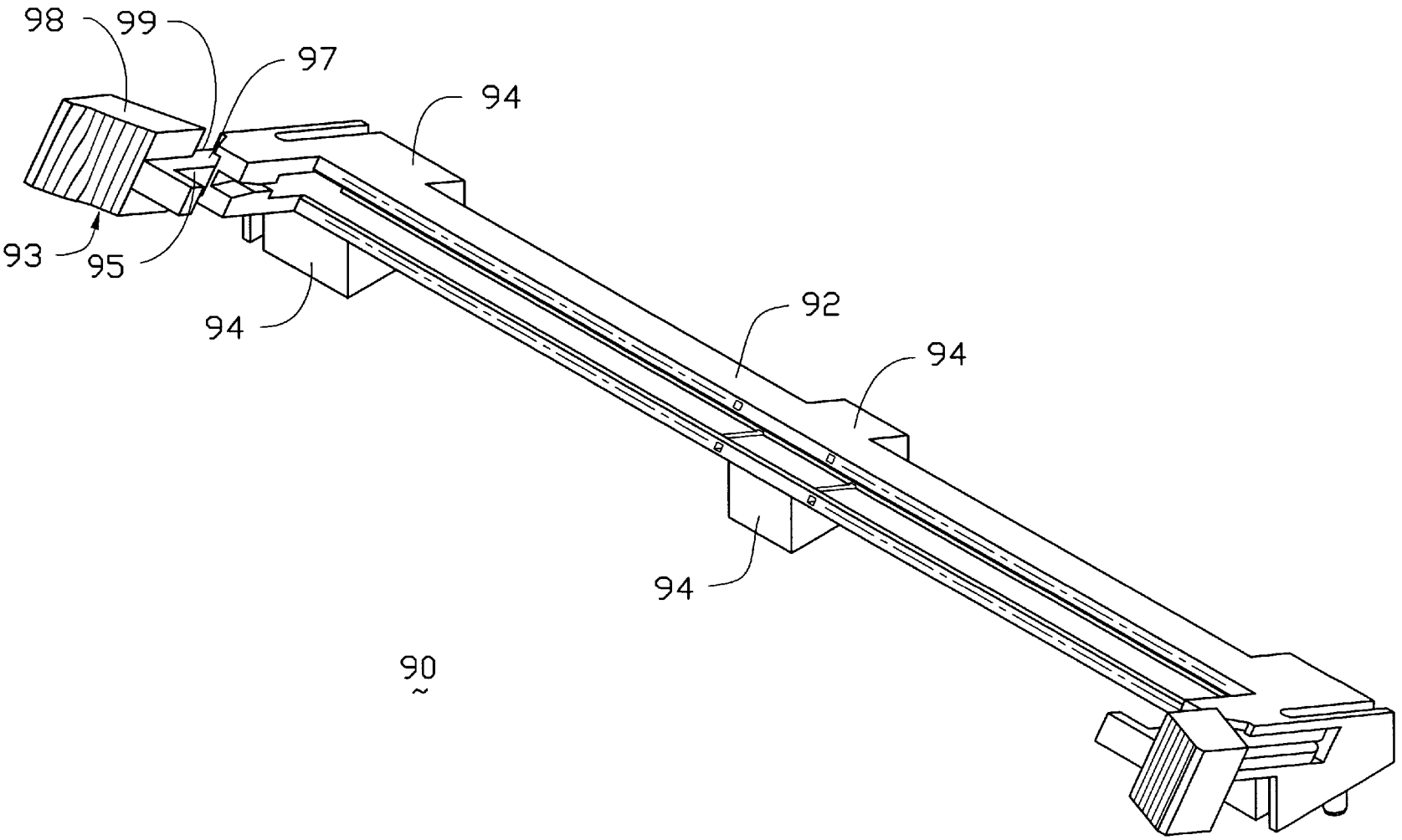
FIG. 7 is another embodiment of a slanted connector having extension portion on the lever of the ejector of easy operation.

FIG. 7 further discloses a third embodiment of the invention wherein the connector 90 includes the housing 92 with three standoff supports 94 respectively adjacent two opposite ends and the middle portion. Different from the first embodiment, there is not cut-off around front portion of the support 94 for position compensation consideration when two connectors 90 are closely mounted on the PC board. The feature of this invention includes an upward extending operation tag 98 generally vertically extends from an edge 99 of the side surface 97 of the main body 95 of the ejector 93. Therefore, when operated by a thumb, the side surface 97 can provide a resting surface for a thumb and the tag 98 can provide an abutment surface for the thumb for efficiently actuating the ejector. This structural relationship becomes so significant especially when the connector 90 is mounted on the PC board in a slanted state with its ejector 93 almost obliquely lying upward for being adapted to be touched by the fingers.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A slanted card edge connector assembly including at least two connectors closely side by side mounted on a PC board, each of said connectors comprising:

an elongated insulative housing defining a central slot for receiving a card therein;

two raised towers disposed adjacent two opposite ends of the housing;

at least a standoff support positioned about a front bottom portion of each of said towers; wherein said support further includes a cut-off generally in alignment with the corresponding tower so as not to interfere with an upper portion of the aligned tower of another adjacent connector which is positioned side by side closely in front of said connector, thereby allowing the connector to be removed from the PC board for repairing without removing said another adjacent connector in front thereof.

2. The assembly as defined in claim 1, wherein plural blocks are formed under front bottom portions and rear bottom portions of the housing.

3. The assembly as defined in claim 1, wherein the cut-off defines a vertical plane which is generally aligned with outermost edge of the upper portion of the aligned tower of said another adjacent connector.

4. A method for mounting at least two slanted type card edge connectors closely side by side on a PC board while allowing of removing anyone connector thereof without interference occurring thereabout, the steps comprising:

providing at least two slanted card connectors mutually closely side by side mounted on the PC board in a front-to-end direction wherein each said connector has an elongated housing including a pair of raised towers at two opposite ends, and a support block is integrally formed under each said tower with a cut-off about a front bottom portion of the tower;

arranging an outermost upper edge of the tower of the front connector not to project over, in a vertical direction, an edge of said cut-off of the rear connector but to project over, in said vertical direction, a front edge of the corresponding support block; and vertically upward removing the rear connector from the PC board without interference between an upper portion of said raised tower of the front connector and the front bottom portion of the rear connector wherein the support block of the rear connector passes aside the outermost edge of the tower of the front connector during upward movement of the rear connector with regard to the front connector.

5. The method as defined in claim 4, wherein each tower further includes an rotatable ejector therein whereby upward moving of the rear connector from the PC board is implemented when said ejector is in an open unlocked manner.

6. A slanted type connector comprising:

an elongated insulative housing having a base plane angular with a PC board on which the connector is mounted;

at least one raised tower positioned adjacent one end of the housing and extending along a same angular direction with the housing;

at least a support block extending in both forward and rearward directions for providing an enlarged standing area of the housing;

an offset surface, which is substantially recessed from a front edge of said support block, aligned with and formed on a lower portion of the tower whereby two of said slanted connectors are side by side, in a front-to-end direction, closely mounted on a PC board with the an outermost edge of the tower of the front connector projecting not over the offset surface of the rear connector in a vertical direction but over the front edge of said corresponding support block of the rear connector in said vertical direction thus allowing the rear connector to be removed from the PC board for repairing without removing the front connector.

7. The connector as defined in claim 6, wherein said offset surface is formed by a cut-off which is generally removed from the support block.

8. The connector as defined in claim 6, wherein said offset surface is perpendicular to the PC board on which the connector is mounted.

9. The connector as defined in claim 6, wherein the outermost edge of the raised tower of the front connector is generally aligned with the offset surface of the rear connector in the vertical direction.

* * * * *